US005395670A

United States Patent [19]

Steinhilber

[11] Patent Number: 5,395,670

[45] Date of Patent: Mar. 7, 1995

[54] APPARATUS FOR DETACHABLY MOUNTING AN ANCHOR PLATE TO A FURNITURE SURFACE

[76] Inventor: Helmut Steinhilber, Sonnenbergstrasse 40, CH-6052 Hergiswil, Switzerland

[21] Appl. No.: 104,207

[22] Filed: Aug. 11, 1993

[30] Foreign Application Priority Data

Aug. 26, 1992 [DE] Germany ..... 42 28 348.5

[51] Int. Cl.[6] ..... C09J 7/02

[52] U.S. Cl. ..... 428/83; 428/99; 428/100; 428/101; 428/343

[58] Field of Search ..... 428/81, 83, 99, 100, 428/101, 343

[56] References Cited

U.S. PATENT DOCUMENTS 4,564,546 1/1986 Jones ..... 428/81

FOREIGN PATENT DOCUMENTS 0457957 10/1990 European Pat. Off. .

*Primary Examiner*—Jenna L. Davis

*Attorney, Agent, or Firm*—Irvin A. Lavine; Gary M. Nath

[57] ABSTRACT

For detachable fixing of a rigid loadable anchor plate (12) to a furniture surface (10), there is used a flexible adhesive-substrate film (36), which is made to adhere to the furniture surface (10). The upwardly bent borders (38, 40) of the film (36) can be attached to the anchor plate (12), e.g., can be securely clamped by means of a clamping plate (30). Thereby the joint between the anchor plate (12) and the film (36) and thus the furniture surface (10) is accessible and detachable from the top side.

11 Claims, 3 Drawing Sheets

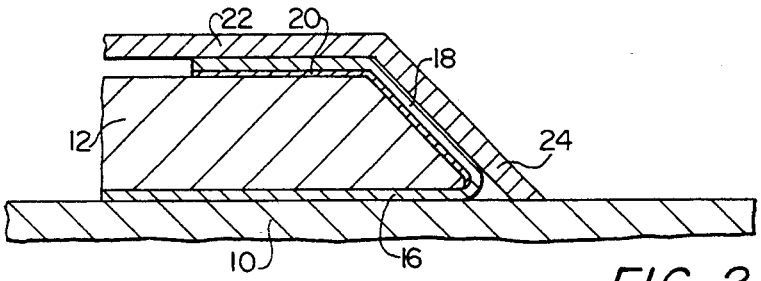
FIG. 2
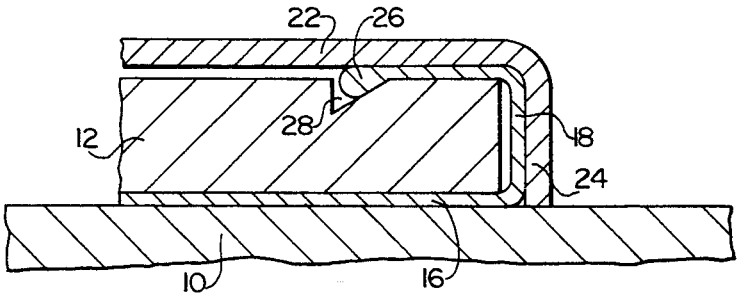
FIG. 3
FIG. 5
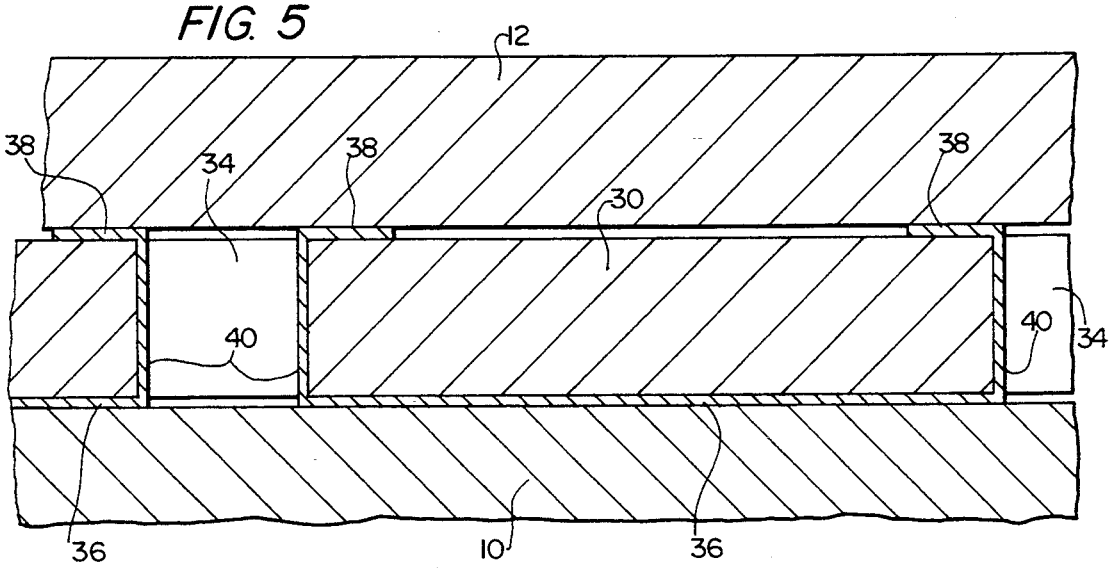

APPARATUS FOR DETACHABLY MOUNTING AN ANCHOR PLATE TO A FURNITURE SURFACE

The invention relates to an apparatus for detachably mounting an anchor plate to a furniture surface.

In the most diverse applications it is necessary to fix a rigid anchor plate to a furniture surface in such a way that the anchor plate can absorb a load. The load can be produced, for example, by a vertical support post mounted on the anchor plate, which post carries a monitor arm, the platform of a raised desk, a telephone arm or the like.

A detachable means of fixing such an anchor plate of the type mentioned initially is known from EP 0 457 957 A1. In this case the anchor plate is fixed to the work surface of a writing desk by means of a stick-on textile fastener. One part of the stick-on textile fastener is made to adhere to the work surface of the writing desk by means of an adhesive. The other part of the stick-on fastener is made to adhere to the underside of the anchor plate, so that the stick-on fastener clings together by hook-and-loop action when the anchor plate is placed on the fastener part adhering to the work surface.

This known fixing means has proved effective in practice. However, difficulties are encountered if the anchor plate must be detached from the furniture surface. In other words, because of the rigid structure of the anchor plate, the stick-on textile fastener must be separated over the entire area of the anchor plate all at one time in order to lift the anchor plate from the furniture surface. As soon as the anchor plate has been removed, the part of the stick-on fastener adhering to the furniture surface can, by virtue of its flexible structure, be stripped and removed from the furniture surface relatively easily.

The object of the invention is to provide an apparatus for fixing a rigid but readily detachable anchor plate to a furniture surface.

The invention is based on the concept of providing a detachable apparatus for mounting a rigid anchor plate in such a way that a flexible adhesive substrate is made to adhere to the furniture surface and the rigid anchor plate is attached to this adhesive substrate by a connector that is accessible and detachable from the top side which faces away from the furniture surface. In the fixed condition, when the flexible adhesive substrate is attached to the anchor plate and a load is acting on the anchor plate, the rigid anchor plate has the effect that the adhesive substrate can only be lifted from the furniture surface if its entire area is detached all at one time. The large-area adhesive joint between the adhesive substrate and the furniture surface thus provides the anchor plate with high loadability, particularly with respect to tilting moments. To detach the fixing means, the connector (accessible from the top side) between adhesive substrate and anchor plate is separated, allowing the rigid anchor plate to be removed from the adhesive substrate. By virtue of its flexible structure, the adhesive substrate can then be peeled progressively from the furniture surface. Since it is no longer necessary to overcome the adherence of the entire area of the adhesive joint all at one time, progressive detachment of the adhesive substrate, if necessary using a solvent, is possible in simple manner and with relatively small expenditure of force.

In one embodiment the adhesive substrate is a film coated with adhesive on one side. The border of the film is bent upward from the furniture surface and joined by attachment to the anchor plate. All attachment-type connector are possible within the scope of the invention, provided merely that they meet two essential criteria, the first being that the connector must have adequate strength, in order to prevent separation of the rigid anchor plate from the foil under the action of the load, and the second being that the connector is accessible and detachable from the top side, so that the connector between anchor plate and film can be separated whenever necessary. The film is preferably a plastic film with appropriate tearing strength. A sufficiently thin steel tape can also be used.

Specifically, the attachment-type connector can be a nonpositive or a positive connector. An adhesive connector or a hook-and-loop connector, for example, can be used as a nonpositive connector. For a positive connector, the upwardly bent border of the film can be provided with a thickened edge that is locked in a corresponding seat on the anchor plate. It can also be expedient to provide a clamping plate that can be tightened together with the anchor plate, the upwardly bent border of the film being immobilized between the anchor plate and the clamping plate. Such clamping of the border between the anchor plate and the clamping plate can then function as the sole means of connection or attachment or can reinforce a nonpositive or positive means of attachment.

In one simple embodiment a continuous adhesive substrate with the same area as the anchor plate is provided. The borders of the adhesive substrate are bent upward along the outside edges and attached to the anchor plate. If a tilting load acts on the anchor plate, the border of the adhesive substrate along the edge of the anchor plate being raised by the tilting load absorbs the entire stress on the joint between the anchor plate and the adhesive substrate adhering securely to the furniture surface. To achieve better load distribution, the adhesive substrate can be subdivided into a plurality of individual substrates disposed side-by-side in the same plane. The borders of all individual substrates are bent upward and attached to the anchor plate. The entire available area of adhesion is reduced only slightly by such subdivision of the adhesive substrate into individual substrates. On the other hand, the force produced between the anchor plate and the adhesive substrate when a tilting moment acts on the anchor plate is advantageously distributed over a plurality of borders, resulting in greater loadability of the fixing means. It is expedient to provide, in the anchor plate or in a clamping plate if provided, slots through which the borders of the individual films functioning as individual substrates can be inserted upwardly. In one expedient embodiment, parallel slots are provided and the individual films of the adhesive substrate are formed as elastically deformable U-shaped sections, the legs of which sections extend through the slots and by means of inwardly directed edges come into overlapping snap-on engagement with the anchor plate or clamping plate. In this embodiment, the shaped sections of the individual films can be snapped on and attached to the fixing means on the anchor plate. The anchor plate can be removed by loosening the attachment-type joint and withdrawing the anchor plate from the shaped sections of the individual films.

The invention will be explained in more detail in the following by reference to practical examples illustrated in the drawing, wherein:

FIG. 2 shows a vertical partial section of the fixing means of FIG. 1,

FIG. 3 shows a vertical partial section analogous to FIG. 2, of a modified embodiment of this fixing means, FIG. 4 shows an exploded diagram of a second embodiment of the fixing means and FIG. 5 shows a vertical partial section through the fixing means of FIG. 4.

A nondeformable anchor plate 12 is fixed to a horizontal furniture surface 10, for example the work surface of a writing desk. The anchor plate 12 carries, for example, a vertical support post 14, on which a monitor arm, the platform of a raised desk, or other similar article is mounted. If these elements being carried by the support post 14 are loaded, a tilting moment is exerted through the support post 14 on the anchor plate 12, which moment tends to lift the anchor plate 12 up from the furniture surface 10 in opposition to its fixing means.

Figure 1:
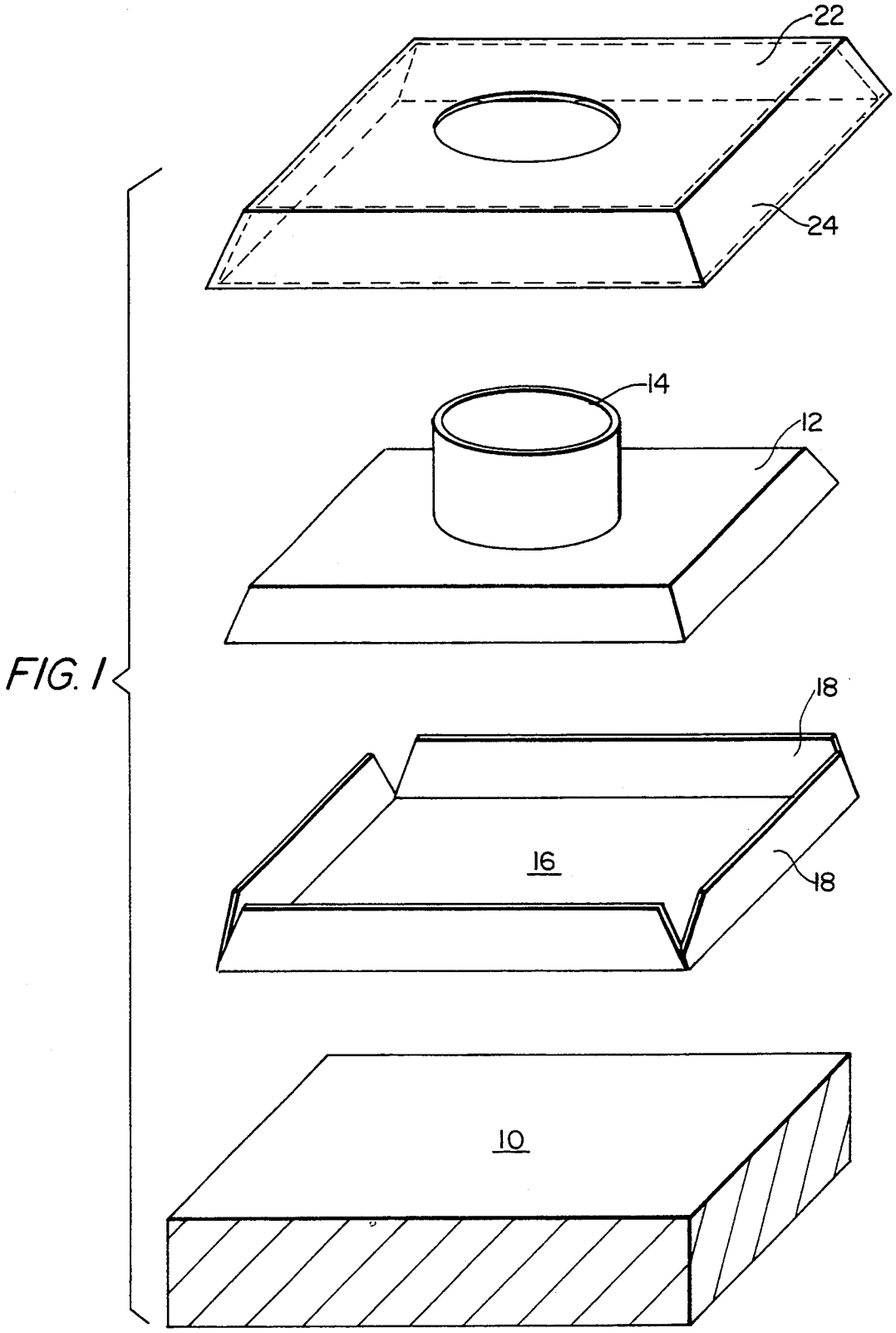
FIG. 1 shows an exploded perspective view of an attaching structure.

In the first practical embodiment of FIGS. 1 and 2, a flexible adhesive substrate in the form of a film 16 of adequate tearing strength functions as the means of fixing the anchor plate 12. The film 16 corresponds in area to the underside of the anchor plate 12. The underside of the film 16 is coated with an adhesive, by means of which it is made to adhere to the furniture surface 10. The anchor plate 12 is placed on the film 16. The borders 18 of the film 16 projecting laterally beyond the anchor plate 12 are bent upward in such way that they rest against the outside edge and top side of the anchor plate 12. The borders 18 are releasably connected to the outside edge and top side of the anchor plate 12. An adhesive coating 20 of the borders 18 can be employed for this purpose. Alternatively, it is possible to use a hook-and-loop fastener for releasably attaching the borders 18 to the outside edge and top side of the anchor plate 12.

On the anchor plate 12 there is placed a cover plate 22, the downwardly angled border 24 of which covers the borders 18 of the film 16, in order to impart an attractive appearance to the overall arrangement.

If desired, the cover plate 22 can also be held tightly together with the anchor plate 12, for example by screws. In this case the cover plate 22 additionally functions as a clamping plate, which immobilizes the borders 18 of the film 16 by clamping them between the anchor plate 12 and the cover plate 22.

FIG. 3 shows a modification of the means of attaching the borders 18 of the film 16. In this embodiment the borders 18 are provided at their outside edge with a bead-like thickening 26, which will fit into a chamfered seat 28 on the top side of the anchor plate 12. The cover plate 22 is tightened as by screws to function as a clamping plate together with the anchor plate 12, forcing the thickened edge 26 into the seat 28. In this way the upwardly bent border 18 of the film 16 is connected or attached positively to the anchor plate 12.

For fixing the anchor plate 12, the film 16 is applied along the anchor plate 12, its edges 18 being attached by means of a adhesive coating 20, by means of the hook-and-loop fastener or by locking in the seat 28 on the clamping plate 12. The cover plate 22 is joined to the anchor plate. The anchor plate 12 can now be made to adhere to the furniture surface 10 by means of the film 16 securely joined to it. To remove the anchor plate 12 from the furniture surface 10 once again, the cover plate 22 is first detached from the anchor plate 12. The borders 18 of the film 16 can now be separated or disconnected from the anchor plate 12 either by pulling the borders 18 away from the adhesive coating 20, separating the hook-and-loop fastening or releasing the thickened edge 26 from the seat 28. The anchor plate 12 is therefore disconnected from the film 16 and can be lifted up therefrom. Thereafter the flexible film 16 is peeled away from the furniture surface 10, beginning at one corner or edge.

Figure 4:
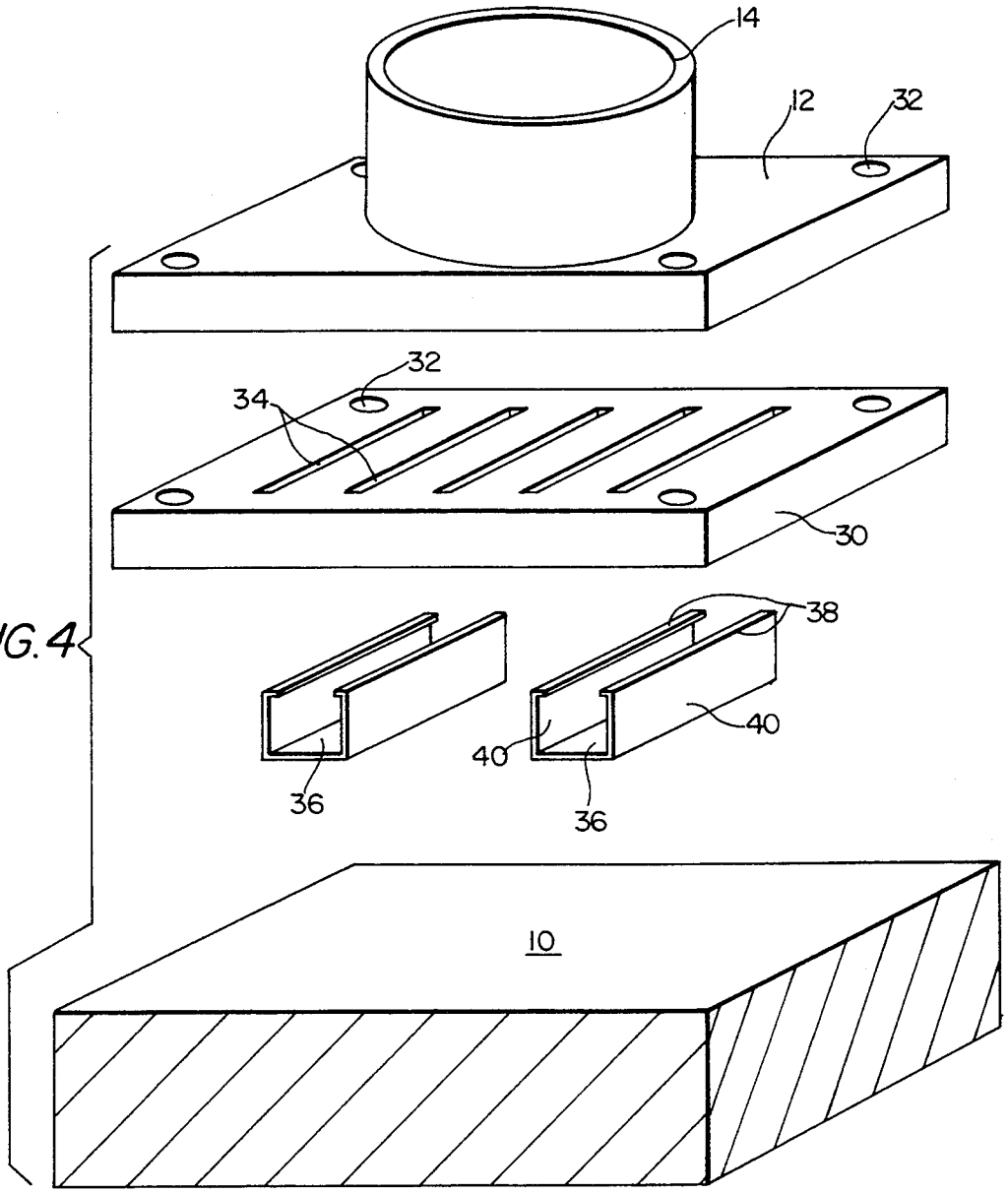

A further embodiment is illustrated in FIGS. 4 and 5. In this embodiment, a clamping plate 30 can be tightened together with the underside of the anchor plate 12, for example by means of screws 32. The clamping plate 30 is provided with parallel slots 34 distributed over its entire area and passing completely through the clamping plate 30. In this embodiment the film functioning as adhesive substrate is subdivided into individual films 36. The individual films 36 are formed as elastically deformable, flexible, U-shaped sections, e.g., as extruded plastic sections or as appropriately formed, thin, flexible steel tape, the edges 38 of the legs 40 of the section being bent inward. The length of the individual films 36 corresponds to the length of the slots 34, whereas the height of the legs 40 of the sections corresponds to the thickness of the clamping plate 30. The width of the inwardly bent edges 38 of the legs 40 of the sections is smaller than the width of the slots 34. The width of the base area of the individual films 36 corresponds to the width of the webs of the clamping plate 30 located between the slots 34.

The individual films 16 coated with adhesive on the underside of their base surface are inserted into the clamping plate 30. For this purpose the legs 40 of the sections are pushed through the slots 34 until the edges 38 engage overlappingly with the top side of the clamping plate 30. By virtue of the elastic deformability of the individual films 36, these snap in captive engagement onto the clamping plate 30. The clamping plate 30 can now be screwed together with the anchor plate 12, so that the edges 38 are securely clamped and immobilized between the anchor plate 12 and the clamping plate 30. The entire arrangement can now be made to adhere to the furniture surface 10 by means of the adhesive coating on the underside of the individual films 36.

To remove the arrangement from the furniture surface 10, the anchor plate 12 is disconnected from the clamping plate 30 by removing screws 32 so that the edges 38 of the individual films 36 are no longer securely clamped. The clamping plate 30 can now be lifted off, by withdrawing it from the legs 40 of the sections, which legs bend apart elastically. Thereafter the flexible individual films 36 can be peeled away from the furniture surface 10.

Terms importing orientation of elements are for convenience, and it will be understood that the furniture surface may be other than a horizontal and/or upper surface.

The claims and specification describe the invention prevented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

I claim:

1. Apparatus for detachably mounting a rigid load bearing anchor plate to the upper surface of an article of furniture comprising:

a flexible substrate having an adhesive lower surface engaging the upper surface of an article of furniture to adhere said substrate thereto, a rigid, load bearing anchor plate on said substrate having upper and lower sides, and a releasable connector at a location on said anchor plate removed from the lower side thereof for releaseably connecting said anchor plate to said flexible substrate.

2. The apparatus according to claim 1, wherein said substrate is a film and said connector comprises upwardly bent borders of said substrate extending at least partly over said anchor plate.

3. The apparatus according to claim 2, said connector further comprising means for nonpositively attaching said borders to the anchor plate.

4. The apparatus according to claim 2, said connector further comprising means for positively attaching said borders to the anchor plate.

5. The apparatus according to claim 3, said attaching means comprising adhesive or a hook-and-loop fastener.

6. The apparatus according to claim 2, and said connector further comprising at least one clamping plate and means for releasably securing said clamping plate to the anchor plate.

7. The apparatus according to claim 6, wherein the border of the film is clamped between the anchor plate and the at least one clamping plate.

8. The apparatus according to claim 4, wherein a said border of film has a thickened edge and said anchor plate has a seat with said thickened edge therein, said clamping plate overlying said border and holding said thickened edge in said seat.

9. The apparatus according to claim 1, there being at least one additional substrate having an adhesive lower surface, said substrates being films arranged side-by-side with lower surfaces in the same plane, and a said detachable connector for each said additional substrate for independently detachably joining each said substrate to said anchor plate.

10. The apparatus according to claim 9, wherein each said substrate has upwardly bent borders and the anchor plate has slots through which said upwardly bent borders extend.

11. The apparatus according to claim 10, wherein the individual substrates each is elastically deformable, said borders having inwardly bent edges in overlapping snap-on engagement with at least one said plate.

* * * * *